US008184776B2

(12) United States Patent
Yuan

(10) Patent No.: US 8,184,776 B2
(45) Date of Patent: May 22, 2012

(54) FILTER AND X-RAY IMAGING APPARATUS USING THE FILTER

(75) Inventor: Ping Yuan, Beijing (CN)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 155 days.

(21) Appl. No.: 12/751,364

(22) Filed: Mar. 31, 2010

(65) Prior Publication Data

US 2010/0246775 A1 Sep. 30, 2010

(30) Foreign Application Priority Data

Mar. 31, 2009 (CN) ..... 2009 1 0132511

(51) Int. Cl.
*G21K 3/00* (2006.01)

(52) U.S. Cl. ..... 378/157; 378/156

(58) Field of Classification Search ..... 378/145, 378/147, 148, 150, 151, 152, 153, 156, 157, 378/159, 160

See application file for complete search history.

(56) References Cited

U.S. PATENT DOCUMENTS

| | | | | |
|---|---|---|---|---|
| 4,246,488 | A | 1/1981 | Hura | |
| 4,300,055 | A | 11/1981 | Taumann | |
| 4,347,440 | A | 8/1982 | Haas | |
| 4,882,741 | A | 11/1989 | Brown | |
| 5,136,627 | A | 8/1992 | Conrads et al. | |
| 5,325,414 | A | 6/1994 | Tanaka et al. | |
| 6,036,362 | A | 3/2000 | Schmitt | |
| 7,072,447 | B2 | 7/2006 | Graf et al. | |
| 7,108,423 | B2 | 9/2006 | Schmitt | |
| 7,260,183 | B2 | 8/2007 | Yuan et al. | |
| 2004/0264647 | A1 | 12/2004 | Graf et al. | |
| 2006/0182226 | A1 * | 8/2006 | Yuan et al. | 378/157 |

FOREIGN PATENT DOCUMENTS

| | | |
|---|---|---|
| JP | 11-076219 | 3/1999 |

* cited by examiner

*Primary Examiner* — Hoon Song
(74) *Attorney, Agent, or Firm* — Armstrong Teasdale LLP

(57) ABSTRACT

A filter includes a plurality of filter plates for adjusting X-ray energy spectrum, a plurality of rails for fixedly supporting the filter plates, a plurality of cams which are respectively provided with a groove curve on a surface thereof, a driving wheel for driving the cams, and a plurality of link levers, each link lever being connected to one of the filter plates at one end and being mounted to an axis at an opposite end such that the link lever is rotatable about the axis, and each link lever being provided with a pin which is in cooperation with the groove curve of the corresponding cam so that the link lever proceeds with a reciprocating movement according to rotation of the corresponding cam to move the filter connected to it into or out of the X-ray passing space. The plurality of cams are respectively located at different sides of the driving wheel to move the filter plates into the X-ray passing space from different directions.

16 Claims, 6 Drawing Sheets

FILTER AND X-RAY IMAGING APPARATUS USING THE FILTER

CROSS REFERENCE TO RELATED APPLICATIONS

This application claims the benefit of Chinese Patent Application No. 200910132511.8 filed Mar. 31, 2009, which is hereby incorporated by reference in its entirety.

BACKGROUND OF THE INVENTION

Embodiments described herein relate to a filter and an X-ray imaging apparatus, and more particularly to a filter that adjusts energy spectra of X-ray, and an X-ray apparatus provided with the filter.

A X-ray imaging apparatus irradiates X-ray to a subject by adjusting energy spectrum of the X-ray with a filter. The filter is provided in a collimator box attached to an X-ray tube. In order to obtain desired spectrum, the filter can be used by switching multiple filter plates which are attached to a rotating disc, as disclosed in the Japanese Patent Application No. HEI11-76219. In this prior art, the energy spectrum can be adjusted in a wide range according to the actual needs, but in the construction in which the filter plates are switched by the rotating disc, a four-step adjustment is about all this construction can provide. Therefore, widening the adjustment range causes a rough step, while providing more steps narrows the adjustment range. When a multi-step adjustment is made possible in the rotating disc system anyway, the rotating disc to which a great number of filters are attached is increased in size, thus unrealistic.

In addition, the U.S. Pat. No. 7,260,183 reveals a filter which is provided with a cam having a curve to adjust laminated filter plates, in order to realize a filter that can make a fine spectrum adjustment in a wide rage and can be miniaturized. However, there are some disadvantages in the technical solution of this prior art: 1. when there are more than two cams in a set of cams, the curve becomes very complex and thus the cam will be in an execrable stressed state, even the angle of the force driving the cam is approximate to the angle of friction. When the cam is rotated to a certain direction or to a certain state, it will be in a more execrable stressed state; 2. since one driving system will drive at most two filter plates in practice, more driving systems are needed to drive two or more filter plates, and thus the disadvantages of high cost, large size and complex structure are caused.

BRIEF DESCRIPTION OF THE INVENTION

An embodiment of the present invention provides a filter, which is provided with less driving systems to realize a fine spectrum adjustment in a wide range, and which has advantages of simple structure, low cost and high reliability. A X-ray imaging apparatus fitted with said filter is also provided.

Moreover, embodiments of the present invention provide a filter, comprising: at least two filter plates for adjusting X-ray energy spectrum; a pair of rails for fixedly supporting the filter plates, said filter plates being provided in a laminated structure on the guiders of the pair of rails; two cams which are respectively provided with a groove curve on a surface thereof; and a driving wheel for driving the cams contacted with it, wherein the filter further comprises at least two link levers, each link lever being connected to one of the filter plates at one end and being mounted to an axis at the other end in the manner that the link lever is rotatable about the axis, and each link lever being provided with a pin which is in cooperation with the groove curve of the corresponding cam so that the link lever proceeds with a reciprocating movement according to rotation of the corresponding cam to move the filter connected to it into or out of the X-ray passing space; the cams are respectively located at different sides of the driving wheel to move the filter plates into the X-ray passing space from different directions.

The number of the filter plates is two; the corresponding cams are respectively located at the left and right sides of the driving wheel, each cam being provided with a groove curve at only one surface thereof; and the filter has two link levers, each link lever being connected to one of the filter plates and being in cooperation with the groove curve of one of the cams.

The filter further comprises a third filter plate and a third link lever, the third link lever being connected to the third filter plate at one end thereof and being provided with a pin; on the other surface of one of the cams is provided with a groove curve which is in cooperation with the pin on the third link lever.

The groove curve on each cam is designed according to the following method: according to N, the number of the filter thickness states that can be switched, calculate the minimum rotation angle of each cam in each thickness switch by 360°/N; set R1, the corresponding radius of the cam groove curve as the minimum one when the filter plate is in the O region retreating from the X-ray passing space; set R2, the corresponding radius of the cam groove curve as the maximum one when the filter plate is in the W region advancing into the X-ray passing space; determine whether the driving wheel is rotated clockwise or anticlockwise; set the O region and W region of the filter plates according to the space size and structure of the collimator box; determine whether the cams are located at the left side or the right side of the filter; and create and design the cam groove curves according to the table below:

| | Switch Order of the Filter Plates | | | | | |
|---|---|---|---|---|---|---|
| | 1 | 2 | 3 | 4 | N | Cam Position |
| Filter Plate 1 | O region or W region? | ... | ... | ... | ... | which side of the filter? |
| Filter Plate 2 | O region or W region? | ... | ... | ... | ... | which side of the filter? |
| Filter Plate ... | O region or W region? | ... | ... | ... | ... | which side of the filter? |
| Operating State of the Filter | Is any filter working? | ... | ... | ... | ... | |

wherein the O region represents the non X-ray passing space; and the W region represents the X-ray passing space.

Assuming the filter plate 1 and the filter plate 2 have thickness of h1 and h2 respectively, then the filter composed of the filter plates has four switches in thickness, i.e. N=4, and the four switches are 0, h1, h2, and h1+h2, wherein 0 indicates that there is no filter in the X-ray passing space; h1 indicates that there is a filter with thickness of h1 in the X-ray passing space; h2 indicates that there is a filter with thickness of h2 in the X-ray passing space; h1+h2 indicates that there is a filter with thickness of h1+h2 in the X-ray passing space; and corresponding to each thickness switch, the cams will be rotated by an angle of 90° calculated by 360°/4; assuming the driving wheel is rotated anticlockwise and the two cams are rotated clockwise, then the table below for the two groove curves can be designed:

| | Switch Order of the Filter Plates | | | | |
|---|---|---|---|---|---|
| | 1 | 2 | 3 | 4 | Cam Position |
| Filter Plate 1 | O | W | O | W | right side |
| Filter Plate 2 | O | O | W | W | left side |
| Operating State of the Filter | 0 | h1 | h2 | h1 + h2 | |

The filter plates are made of copper or tin; h1 and h2 are respectively 0.1 mm and 0.2 mm.

The filter plate 1 and the filter plate 2 have thickness of h1, h2 respectively; with an additional filter plate 3 with thickness of hn, the filter composed of the filter plates has four thickness switches plus a switch of thickness hn, i.e. N=5, and the switches are 0, h1, h2, h1+h2, and hn; and corresponding to each thickness switch, the cams will be rotated by an angle of 72° calculated by 360°/5; assuming the driving wheel is rotated anticlockwise and the cams located respectively at left side and right side of the driving wheel are rotated clockwise, then a table below for three groove curves can be designed, wherein groove curves for respectively controlling the filter plate 1 with thickness of h1 and the filter plate 3 with thickness of hn are respectively provided on the front surface and the back surface of the cam located at the right side:

| | Switch Order of the Filter Plates | | | | | |
|---|---|---|---|---|---|---|
| | 1 | 2 | 3 | 4 | 5 | Cam Position |
| Filter Plate 1 | O | W | O | W | O | right side |
| Filter Plate 3 | O | O | O | O | W | right side |
| Filter plate 2 | O | O | W | W | O | left side |
| Operating State of the Filter | 0 | h1 | h2 | h1 + h2 | hn | |

The filter plate 1 and the filter plate 2 are made of copper or tin; h1 and h2 are respectively 0.1 mm and 0.2 mm; and the filter plate 3 is made of tin or copper.

The filter plate 1 and the filter plate 2 have thickness of h1 and h2 respectively; with an additional filter plate 3 with thickness of hn, the filter composed of the filter plates has four thickness switches plus one more thickness switch of hn+h2+h1, i.e. N=5, and the switches are 0, h1, h2, h1+h2, and hn+h1+h2; and corresponding to each thickness switch, the cams will be rotated by 72° calculated by 360°/5; assuming the driving wheel is rotated anticlockwise and the cams located respectively at the left and right sides of the driving wheel are rotated clockwise, then the table below for three groove curves can be designed, wherein groove curves for respectively controlling the filter plate 1 with thickness of h1 and the filter plate 3 with thickness of hn are respectively provided on the front surface and the back surface of the cam located at the right side:

| | Switch Order of the Filter Plates | | | | | |
|---|---|---|---|---|---|---|
| | 1 | 2 | 3 | 4 | 5 | Cam Position |
| Filter Plate 1 | O | W | O | W | W | right side |
| Filter Plate 3 | O | O | O | O | W | right side |
| Filter plate 2 | O | O | W | W | W | left side |
| Operating state of the Filter | 0 | h1 | h2 | h1 + h2 | hn + h1 + h2 | |

The filter plate 1 and the filter plate 2 are made of copper or tin; h1 and h2 are respectively 0.1 mm and 0.2 mm; and the filter plate 3 is made of tin or copper.

Another embodiment of the present invention provides an X-ray imaging apparatus for imaging a subject by X-ray via a filter, wherein said filter comprises: at least two filter plates for adjusting X-ray energy spectrum; a pair of rails for fixedly supporting the filter plates, said filter plates being provided in a laminated structure on the guiders of the pair of rails; two cams which are respectively provided with a groove curve on a surface thereof; and a driving wheel for driving the cams contacted with it, wherein the filter further comprises at least two link levers, each link lever being connected to one of the filter plates at one end and being mounted to an axis at the other end in the manner that the link lever is rotatable about the axis, and each link lever being provided with a pin which is in cooperation with the groove curve of the corresponding cam so that the link lever proceeds with a reciprocating movement according to rotation of the corresponding cam to move the filter connected to it into or out of the X-ray passing space; the cams are respectively located at different sides of the driving wheel to move the filter plates into the X-ray passing space from different directions.

The filter has two filter plates; the corresponding cams are respectively located at the left and right sides of the driving wheel, each cam being provided with a groove curve at only one surface thereof; and the filter has two link levers, each link lever being connected to one of the filter plates and being in cooperation with the groove curve of one of the cams.

The filter further comprises a third filter plate and a third link lever, the third link lever being connected to the third filter plate at one end thereof and being provided with a pin; on the other surface of one of the cams is provided with a groove curve which is in cooperation with the pin on the third link lever.

The groove curve on each cam is designed according to the following method: according to N, the number of the filter thickness states that can be switched, calculate the minimum rotation angle of each cam in each thickness switch by 360°/N; set R1, the corresponding radius of the cam groove curve as the minimum one when the filter plate is in the O region retreating from the X-ray passing space; set R2, the corresponding radius of the cam groove curve as the maximum one when the filter plate is in the W region advancing into the X-ray passing space; determine whether the driving wheel is rotated clockwise or anticlockwise; set the O region and W region of the filter plates according to the space size and structure of the collimator box; determine whether the cams are located at the left side or the right side of the filter; and create and design the cam groove curves according to the table below:

| | Switch Order of the Filter Plates | | | | | |
|---|---|---|---|---|---|---|
| | 1 | 2 | 3 | 4 | N | Cam Position |
| Filter Plate 1 | O region or W region? | ... | ... | ... | ... | which side of the filter? |
| Filter Plate 2 | O region or W region? | ... | ... | ... | ... | which side of the filter? |
| Filter Plate ... | O region or W region? | ... | ... | ... | ... | which side of the filter? |
| Operating State of the Filter | Is any filter working? | ... | ... | ... | ... | |

wherein the O region represents the non X-ray passing space; and the W region represents the X-ray passing space.

Assuming the filter plate 1 and the filter plate 2 have thickness of h1 and h2 respectively, then the filter composed of the filter plates has four switches in thickness, i.e. N=4, and the four switches are 0, h1, h2, and h1+h2, wherein 0 indicates that there is no filter in the X-ray passing space; h1 indicates that there is a filter with thickness of h1 in the X-ray passing space; h2 indicates that there is a filter with thickness of h2 in the X-ray passing space; h1+h2 indicates that there is a filter with thickness of h1+h2 in the X-ray passing space; and corresponding to each thickness switch, the cams will be rotated by an angle of 90° calculated by 360°/4; assuming the driving wheel is rotated anticlockwise and the two cams are rotated clockwise, then the table below for the two groove curves can be designed:

| | Switch Order of the Filter Plates | | | | |
|---|---|---|---|---|---|
| | 1 | 2 | 3 | 4 | Cam Position |
| Filter Plate 1 | O | W | O | W | right side |
| Filter Plate 2 | O | O | W | W | left side |
| Operating State of the Filter | 0 | h1 | h2 | h1 + h2 | |

The filter plates are made of copper or tin; h1 and h2 are respectively 0.1 mm and 0.2 mm.

The filter plate 1 and the filter plate 2 have thickness of h1, h2 respectively; with an additional filter plate 3 with thickness of hn, the filter composed of the filter plates has four thickness switches plus a switch of thickness hn, i.e. N=5, and the switches are 0, h1, h2, h1+h2, and hn; and corresponding to each thickness switch, the cams will be rotated by an angle of 72° calculated by 360°/5; assuming the driving wheel is rotated anticlockwise and the cams located respectively at left side and right side of the driving wheel are rotated clockwise, then a table below for three groove curves can be designed, wherein groove curves for respectively controlling the filter plate 1 with thickness of h1 and the filter plate 3 with thickness of hn are respectively provided on the front surface and the back surface of the cam located at the right side:

| | Switch Order of the Filter Plates | | | | | |
|---|---|---|---|---|---|---|
| | 1 | 2 | 3 | 4 | 5 | Cam Position |
| Filter Plate 1 | O | W | O | W | O | right side |
| Filter Plate 3 | O | O | O | O | W | right side |
| Filter plate 2 | O | O | W | W | O | left side |
| Operating State of the Filter | 0 | h1 | h2 | h1 + h2 | hn | |

The filter plate 1 and the filter plate 2 are made of copper or tin; h1 and h2 are respectively 0.1 mm and 0.2 mm; and the filter plate 3 is made of tin or copper.

The filter plate 1 and the filter plate 2 have thickness of h1 and h2 respectively; with an additional filter plate 3 with thickness of hn, the filter composed of the filter plates has four thickness switches plus one more thickness switch of hn+h2+h1, i.e. N=5, and the switches are 0, h1, h2, h1+h2, and hn+h1+h2; and corresponding to each thickness switch, the cams will be rotated by 72° calculated by 360°/5; assuming the driving wheel is rotated anticlockwise and the cams located respectively at the left and right sides of the driving wheel is rotated clockwise, then the table below for three groove curves can be designed, wherein groove curves for respectively controlling the filter plate 1 with thickness of h1 and the filter plate 3 with thickness of hn are respectively provided on the front surface and the back surface of the cam located at the right side:

| | Switch Order of the Filter Plates | | | | | |
|---|---|---|---|---|---|---|
| | 1 | 2 | 3 | 4 | 5 | Cam Position |
| Filter Plate 1 | O | W | O | W | W | right side |
| Filter Plate 3 | O | O | O | O | W | right side |
| Filter plate 2 | O | O | W | W | W | left side |
| Operating state of the Filter | 0 | h1 | h2 | h1 + h2 | hn + h1 + h2 | |

The filter plate 1 and the filter plate 2 are made of copper or tin; h1 and h2 are respectively 0.1 mm and 0.2 mm; and the filter plate 3 is made of tin or copper.

In the present invention, a single driving wheel drives multiple cams that have different curves. The cams are respectively located at different sides of the driving wheel, so that the cams driven by the driving wheel move the filter plates connected thereto into FOV of the X-ray respectively from different sides (FOV is the abbreviation of Field of View). In the present invention, the number of driving systems and motors are reduced, and a driving system can satisfy the case of four cam curves. Therefore, the present invention reduces the components number and complexity in structure, enhances reliability and cuts the cost. In the meantime, the structure according to the present invention increases the margin between the filter plates, and thus decreases the requirement on filter plate position repeatability accuracy, because the size of the filter plates can be optimized and increased, and the filter plates can be withdrawn sufficiently.

In addition, by the cam design method according to the present invention, the cam curve becomes more simple and the strained condition is improved.

DETAILED DESCRIPTION OF THE INVENTION

Embodiments according to the present invention will be described in detail in the following text with reference to the Drawings. It should be apprehended that the present invention shall not be limited to these specific embodiments.

Figure 1:
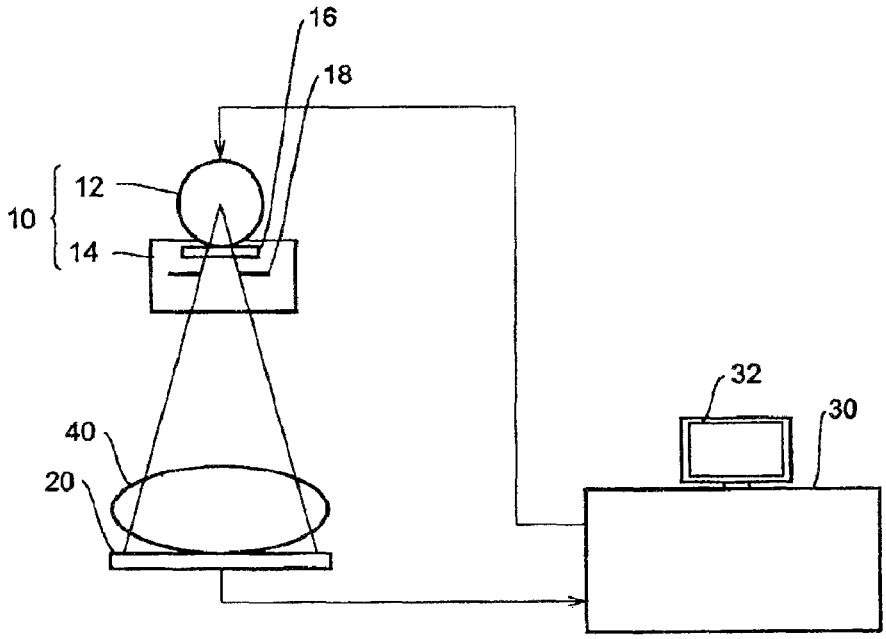
FIG. 1 is a view showing the structure of one example of an X-ray imaging apparatus according to the best mode for carrying out the present invention.

FIG. 1 shows the structure of a X-ray imaging apparatus according to the present invention. The X-ray imaging apparatus is an example of the present invention, and comprises an X-ray irradiating device 10, X-ray detecting device 20 and an operator controller 30. The X-ray irradiating device 10 and the X-ray detecting device oppose to each other via a subject 40.

The X-ray irradiating device 10 has an X-ray tube 12 and a collimator box 14. A filter 16 and a collimator 18 are accommodated in the collimator box 14. The filter 16 is one example of the present invention.

X-ray emitted from the X-ray tube 12 whose energy spectra are adjusted by the filter 16 is irradiated to the subject 40 through an opening of the collimator 18. The filter 16 can make the energy spectra variable. The collimator 18 has the opening that is variable.

The X-ray passing through the subject 40 is detected by the X-ray detecting device 20 to be inputted to the operator controller 30. The operator controller 30 reconstructs the radioscopic image of the subject based upon an inputted signal. The reconstructed radioscopic image is displayed on a display 32 of the operator controller 30. The operator controller 30 further controls the X-ray irradiating device 10. The control of the X-ray irradiating device 10 by the operator controller 30 includes the control of the filter 16 and the control of the collimator 18. It should be noted that the filter 16 and the collimator 18 can manually be adjusted according to actual need.

Figure 2:
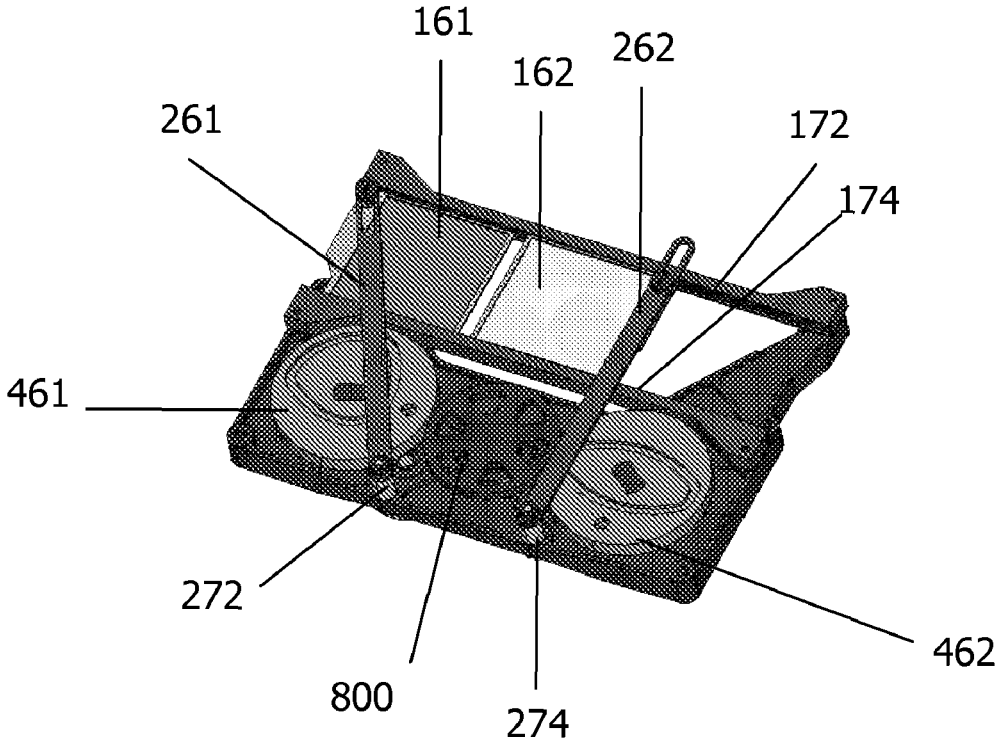
FIG. 2 and FIG. 3 are two different views of an example of the filter structure according to the present invention.

FIG. 2 is a view showing the structure of a filter 16 according to the present invention. As shown in FIG. 2, filter plates 161, 162 are provided in a laminated structure on a pair of rails 172, 174. The rails 172, 174 are parallel with each other, each rail having parallel rails in equal amount with the filter plates. The two ends of each filter plate are respectively inserted into the corresponding guider of the pair of rails 172, 174, so that the filter plates are formed into a laminated structure, and each filter plate is movable parallelly between the pair of rails 172, 174. The filter plates 161, 162 are respectively connected to one ends of link levers 261, 262, while the other ends of the link levers 261, 262 are mounted to axes 272, 274 to be rotatable about the axes 272, 274. Cams 461, 462 for driving the link levers 261, 262 are provided with groove curves, while the link levers 261, 262 are provided with pins to cooperate with the groove curves on the cams 461, 462. The two cams 461, 462 are located respectively at different sides of the driving wheel 800, which drives the cams 461, 462 simultaneously to rotate and thus to move the filter plates 161, 162 into and out of the FOV region of the X-ray from different directions.

Figure 3:
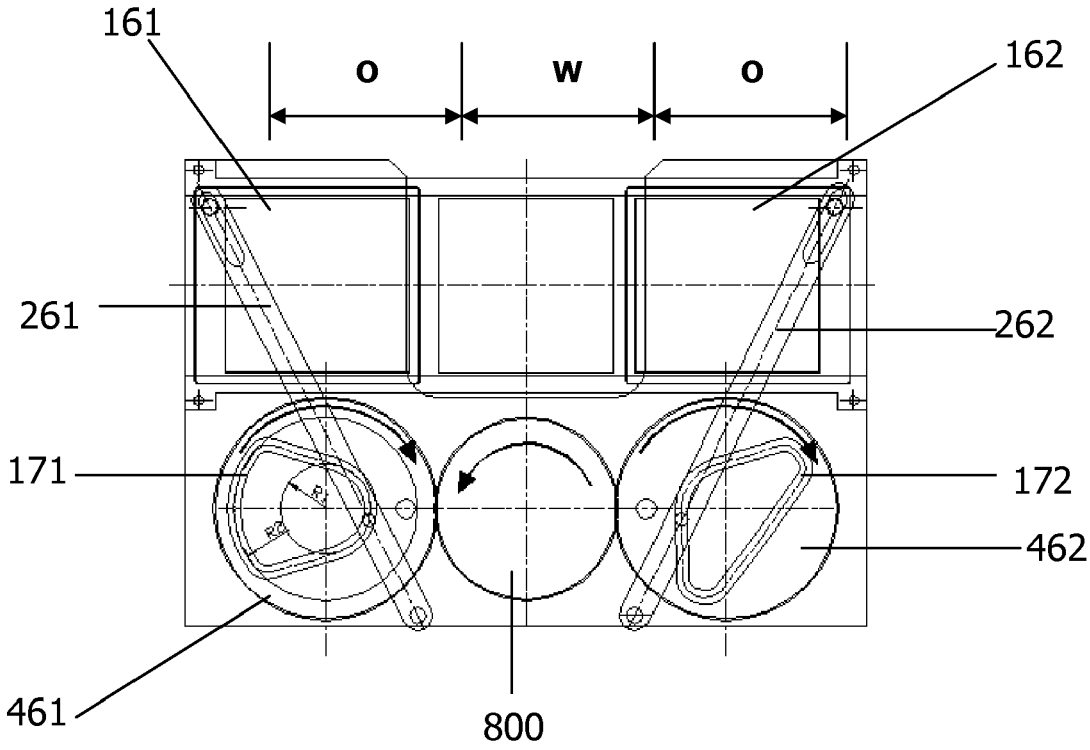

As shown in FIG. 3, the link levers 261, 262 driven by the cams 461, 462 make the filter plates 161, 162 proceed with a reciprocating movement respectively along the rails 171, 172. The filter plate 161 and/or the filter plate 162 are in the advancing state into the X-ray passing space when they are present in the W region, while they are in the retreating state when they are respectively present at the left and right O region. In the present invention, the structure is simplified, since the filter plates 161, 162 are moved in/out through the reciprocating movement of the link levers 261, 262 driven by the rotation of the cams 461, 462, while the rotation of the cams are driven by a single driving wheel 800.

As stated above, through rotation, the cams 461, 462 have the function of switching positions of the filter plates in a binary mode between the advancing position where the filter plates move into the X-ray passing space and the retreating position where the filter plates move out of the X-ray passing space.

As shown in FIG. 3, the groove curve of each cam according to the present invention is designed following the method below:

1. According to N, the number of the filter thickness states that can be switched, calculate the rotation angle of each cam in each thickness switch by 360°/N;

2. Set the O region to correspond to R1, the minimum radius of the cam groove curve;

3. Set the W region to correspond to R2, the maximum radius of the cam groove curve;

4. Determine the rotation direction of the driving wheel 800, e.g. the clockwise direction or the anticlockwise direction;

5. Set the O region and W region of the filter plate according to the space size and structure of the collimator box;

6. Determine which side of the filter the cam is positioned, e.g. the left side or the right side;

7. Create a table for designing the groove curve of the cam and a graph of the groove curve.

The method for designing the groove curve will be described through the specific examples below.

EXAMPLE 1

Assuming there are two filter plates 161, 162 made of copper which have thickness of 0.2 mm and 0.1 mm respectively, then the filter composed of the same will have four different thickness switches, i.e. N=4 (N=4, e.g. 0.0 mm, 0.1 mm, 0.2 mm, 0.3 mm; wherein 0.0 mm indicates that no filter is present in the X-ray passing space; 0.1 mm indicates that a filter with thickness of 0.1 mm is present in the X-ray passing space; 0.2 mm indicates that a filter with thickness of 0.2 mm is present in the X-ray passing space; 0.3 mm indicates that a filter with thickness of 0.3 mm is present in the X-ray passing space), and corresponding to each thickness, the cam shall be rotated by an angle of 90° calculated by 360°/4; assuming the driving wheel 800 is rotated anticlockwise, then the two cams 461, 462 are rotated clockwise. Two groove curves 471, 472 are designed on the cams 461, 462 as shown in FIG. 4A according to Table 1.

TABLE 1

| | Switch Order of the Filter Plates | | | | |
|---|---|---|---|---|---|
| | 1 | 2 | 3 | 4 | Cam Position |
| Filter plate, 0.1 mm | O | W | O | W | right side |
| Filter plate, 0.2 mm | O | O | W | W | left side |
| Operating state of the Filter | 0.0 mm | 0.1 mm | 0.2 mm | 0.3 mm | |

Figure 4A:
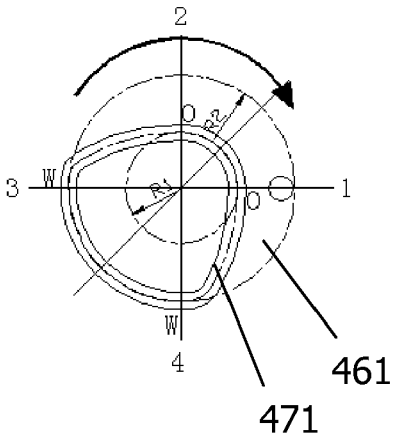
FIGS. 4A and 4B are schematic drawings of the curves designed on the two cams in example 1.
Figure 4B:
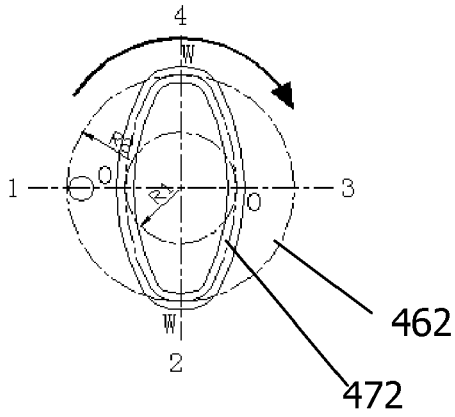
Figure 4C:
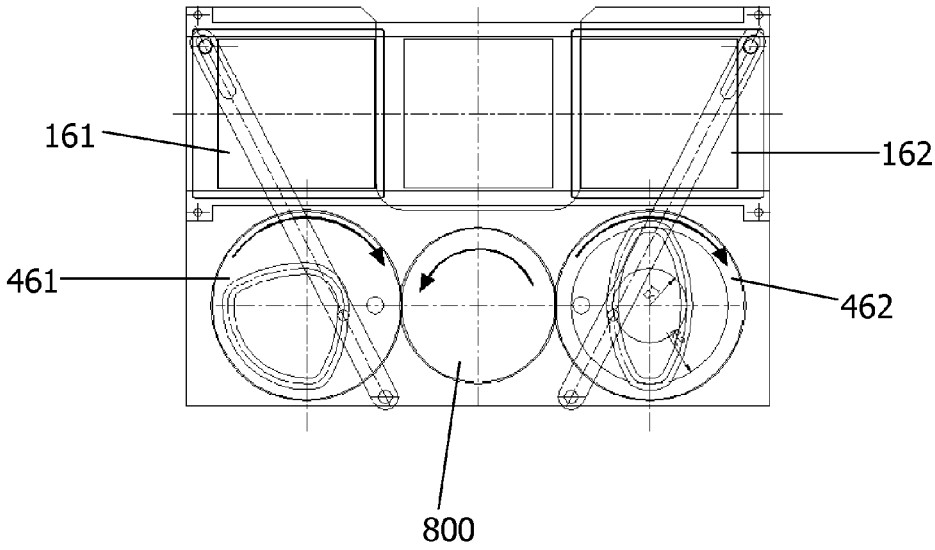
FIG. 4C is a schematic drawing of the filter in example 1.
Figures 4D, 4E, 4F, 4G:
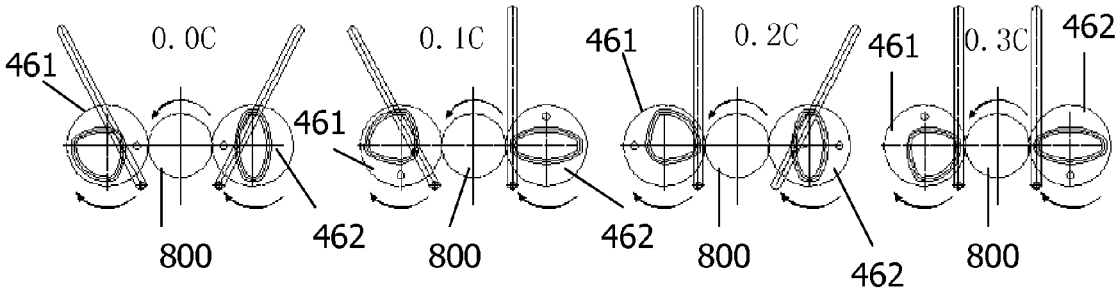
FIGS. 4D, 4E, 4F, and 4G are schematic drawings showing the operating states of the filter in example 1.

FIG. 4C shows the filter mounted according to Table 1 and FIGS. 4A and 4B, with a operating state as shown in FIGS. 4D-4G. It can be seen that from the 0.0 mm state to the 0.3 mm state, each cam is rotated by 90° with each operating state switch; between the 0.0 mm state and the 0.1 mm state, or between the 0.0 mm state and the 0.3 mm state, the minimum cam rotation angle is 90°; between the 0.1 mm state and the 0.3 mm state, or between the 0.3 mm state and the 0.1 mm state, the minimum cam rotation angle is 180°; between the 0.0 mm state and the 0.2 mm state or between the 0.1 mm state and the 0.3 mm state, the minimum cam rotation angle is 180°.

EXAMPLE 2

Figure 5A:
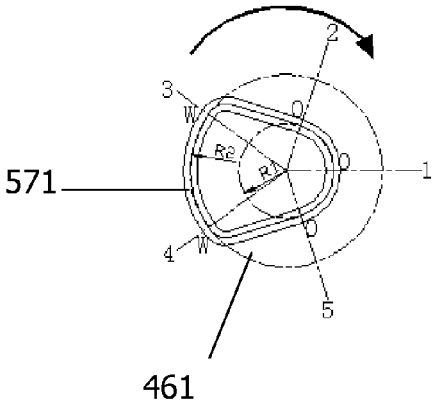
FIGS. 5A, 5B, and 5C are schematic drawings showing the curves designed on the three cams in example 2.
Figure 5B:
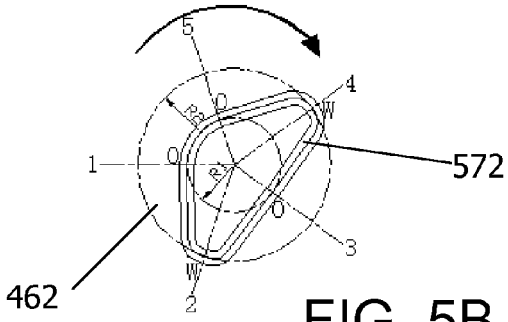
Figure 5C:
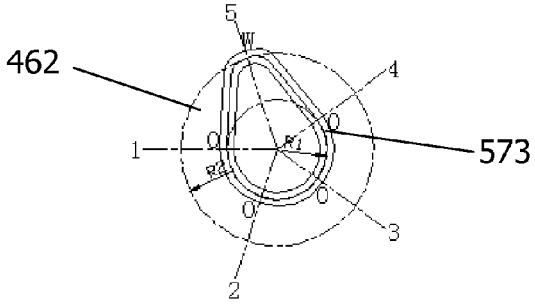
Figure 5D:
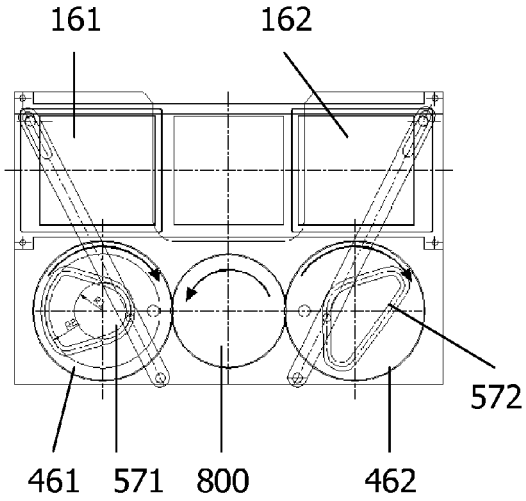
FIGS. 5D and 5E are schematic drawings viewed from the front side and the back side of the filter in example 2.
Figure 5E:
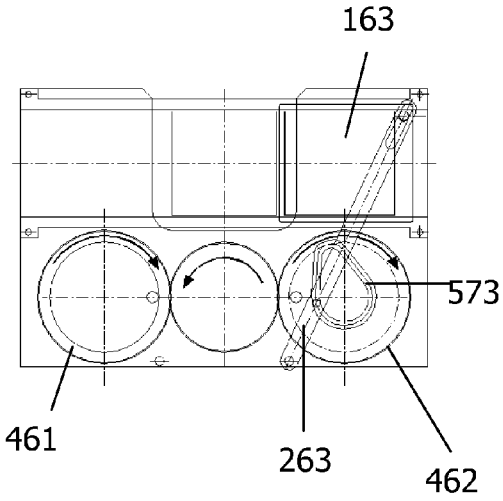
Figures 5F, 5G, 5H, 5I, 5J:
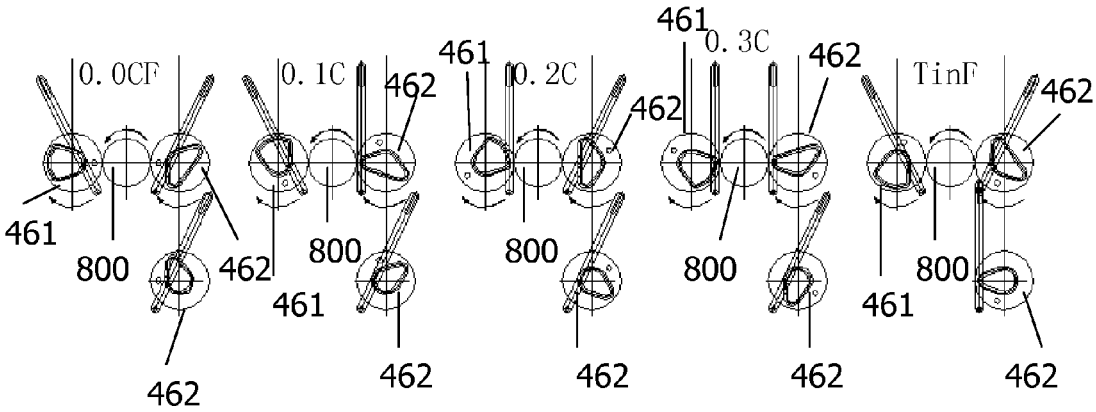
FIGS. 5F, 5G, 5H, 5I, and 5J are schematic drawings showing the operating states of the filter in example 2.

For example, there are two filter plates 161, 162 made of copper which have the thickness of 0.2 mm and 0.1 mm respectively; and a filter plate 163 which has the thickness of hn (as shown in FIGS. 5D and 5E). Assuming the filter composed of the above filter plates has 4 copper filter thickness switches and 1 tin filter thickness switch, i.e. N=5, (N=5, e.g. 0.0 mm, 0.1 mm, 0.2 mm, 0.3 mm, hn), then corresponding to each thickness switch, the cam shall be rotated by an angle of 72° calculated by 360°/5; assuming the driving wheel 800 is rotated anticlockwise, then the cams 461, 462 at the left side and the right side of the driving wheel 800 respectively will be rotated clockwise. Three groove curves 571, 572, 573 as shown in FIGS. 5A-5C are designed according to Table 2, wherein on the front surface and the back surface of the cam 462 are respectively provided with groove curves 572, 573 for respectively controlling the copper filter plate 162 with the thickness of 0.1 mm and the tin filter plate. A third link lever 263 is further included, with one of its end connected to the tin filter plate. A pin (with no reference number) is provided on the third link lever 263 to cooperate with the groove curve 573 on the back surface of the cam 462.

TABLE 2

| | Switch Order of the Filter Plates | | | | | |
|---|---|---|---|---|---|---|
| | 1 | 2 | 3 | 4 | 5 | Cam Position |
| Filter Plate, 0.1 mm | O | W | O | W | O | right side |
| Filter Plate, hn | O | O | O | O | W | right side |
| Filter Plate, 0.2 mm | O | O | W | W | O | left side |
| Operating state of the Filter | 0.0 mm | 0.1 mm | 0.2 mm | 0.3 mm | hn | |

FIGS. 5D and 5E are two schematic drawings showing the front side and the back side of the filter mounted by two cams 461, 462 according to Table 2 and FIGS. 5A-5C. The operating states of the filter is shown in FIGS. 5F-5J. It can be seen that from the 0.0 mm state to the 0.3 mm state and then to the hn state, each cam is rotated by 72° along with each operating state switch, wherein between the 0.0 mm state and the hn state or between the hn state and the 0.0 mm state, the minimum cam rotation angle is 72°; between the 0.1 mm state and the 0.2 mm state and the hn state, the minimum cam rotation angle is 144°.

Figure 6A:
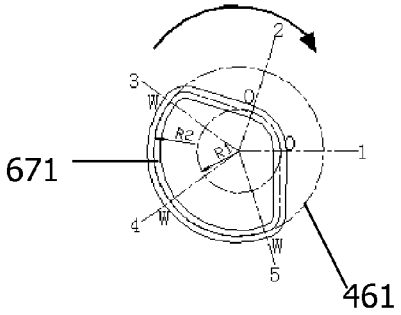
FIGS. 6A, 6B, and 6C are schematic drawings showing the curves designed on the three cams in example 3.
Figure 6B:
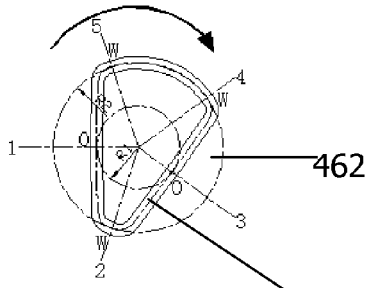
Figure 6C:
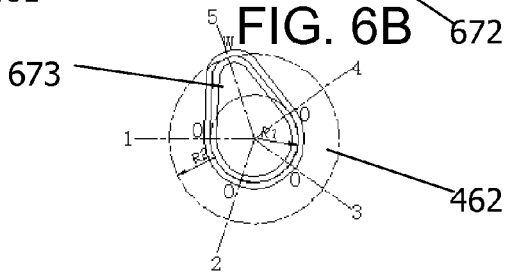

If the required thickness switch states include four copper filter thickness switches and one tin filter thickness plus 0.3 mm, i.e. N=5, (N=5, 0.0 mm, 0.1 mm, 0.2 mm, 0.3 mm, hn+0.3 mm), then three groove curves 671, 672, 673 as shown in FIGS. 6A-6C are designed according to Table 3, wherein groove curves 672, 673 are provided on the front surface and the back surface of the cam 462 for respectively controlling the copper filter plate 62 with thickness of 0.1 mm and the tin filter plate 163.

TABLE 3

| | Switch Order of the Filter Plates | | | | | |
|---|---|---|---|---|---|---|
| | 1 | 2 | 3 | 4 | 5 | Cam Position |
| Filter Plate, 0.1 mm | O | W | O | W | W | Right side |
| Filter Plate, hn | O | O | O | O | W | Right side |
| Filter Plate, 0.2 mm | O | O | W | W | W | Left side |
| Operating state of the Filter | 0.0 mm | 0.1 mm | 0.2 mm | 0.3 mm | hn + 0.3 mm | |

Figure 6D:
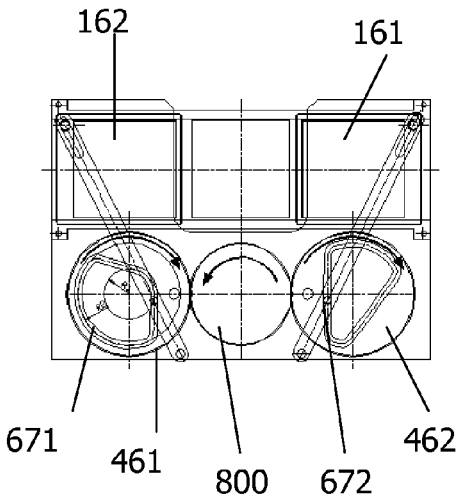
FIGS. 6D and 6E are schematic drawings viewed from the front side and the back side of the filter in example 3.
Figure 6E:
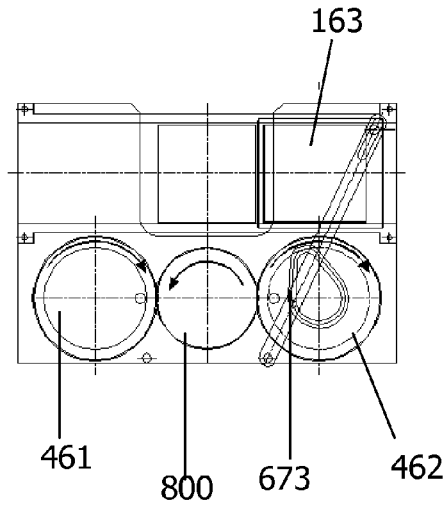
Figures 6F, 6G, 6H, 6I, 6J:
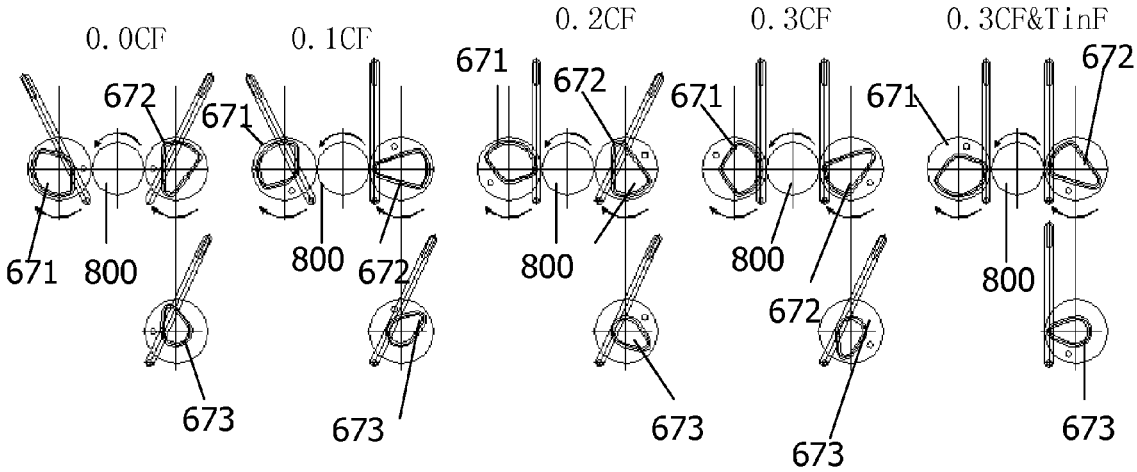
FIGS. 6F, 6G, 6H, 6I, and 6J are schematic drawings showing the operating states of the filter in example 3.

FIGS. 6D and 6E are schematic drawings showing the front side and the back side of the filter mounted by the two cams 461, 462 designed according to Table 3 and FIGS. 6A-6C. The operating states of the filter are shown in FIGS. 6F-6J. It can be seen that from the 0.0 mm state to the 0.3 mm state and then to the hn+0.3 mm state, each cam will be rotated by 72° along with each operating state switch.

Of course, all the filter plates as described in the present invention can be made of copper or tin or other materials which are suitable for filtering.

In FIGS. 4D-4G, 5F-5J, and 6F-6J, 0.0CF, 0.1CF, 0.2CF and 0.3CF refer to copper filter, 0.0 mm; copper filter, 0.1 mm; and copper filter, 0.2 mm; and copper filter, 0.3 mm respectively; TinF refers to tin filter.

What is claimed is:

1. A filter, comprising:

a plurality of filter plates configured to adjust an X-ray energy spectrum, wherein the plurality of filter plates comprises three filter plates;

a plurality of rails for fixedly supporting the filter plates, the filter plates being provided in a laminated structure on guiders of the plurality of rails;

a plurality of cams which are respectively provided with a groove curve on a surface thereof, wherein a surface of one of the cams comprises a second groove curve;

a driving wheel configured to drive the plurality of cams; and a plurality of link levers comprising three link levers, each link lever being connected to one of the filter plates at a first end and being mounted to an axis at an opposite second end such that the link lever is rotatable about the axis, each link lever comprising a pin which is in cooperation with the groove curve of the corresponding cam so that the link lever proceeds with a reciprocating movement according to rotation of the corresponding cam to move the filter connected to it into or out of an X-ray passing space, wherein the plurality of cams are respectively located at a left side and a right side of the driving wheel to move the filter plates into the X-ray passing space from different directions, wherein the second groove curve of the one of the cams which is in cooperation with the pin on a third link lever.

2. A filter according to claim 1, wherein the groove curve on each cam is based by:

where N is a number of filter thickness states that can be switched, a calculated minimum rotation angle of each cam in each thickness switch by 360°/N;

a corresponding radius of the groove curve is set as minimum value when one of the plurality of filter plates is in an O region retreating from the X-ray passing space;

the corresponding radius of the groove curve is set as a maximum value when the one of the plurality of filter plates is in a W region advancing into the X-ray passing space;

a determination of whether the driving wheel is rotated clockwise or anticlockwise;

a setting of the O region and W region of the filter plates according to a space size and structure of a collimator box; and a determination of whether the plurality of cams are located at a left side or a right side of the filter, wherein the O region represents the non X-ray passing space and the W region represents the X-ray passing space.

3. A filter according to claim 2, wherein the plurality of filter plates comprises a first filter plate having a first thickness and a second filter plate having a second thickness such that the filter has one of a first thickness that indicates that there is no filter in the X-ray passing space, a second thickness that indicates that the filter includes the first filter plate with the first thickness in the X-ray passing space, a third thickness that indicates that the filter includes the second filter plate with the second thickness in the X-ray passing and a fourth thickness that indicates that the filter includes the first filter plate and the second filter plate in the X-ray passing space, and wherein, corresponding to each thickness, the plurality of cams will be rotated by an angle of 90° such that the driving wheel is rotated anticlockwise and the plurality of cams are rotated clockwise.

4. A filter according to claim 2, wherein the plurality of filter plates comprises a first filter plate having a first thickness, a second filter plate having a second thickness, and a third filter plate having a third thickness, such that a thickness of the filter is one of zero, the first thickness, the second thickness, a sum of the first thickness and the second thickness, and the third thickness, wherein, corresponding to each thickness, the plurality of cams are rotated by an angle of 72° such that the driving wheel is rotated anticlockwise and the plurality of cams are located respectively at a left side and at a right side of the driving wheel are rotated clockwise, and wherein groove curves for respectively controlling the first filter plate and the third filter plate are respectively provided on a front surface and a back surface of the cam located at the right side.

5. A filter according to claim 2, wherein the plurality of filter plates comprises a first filter plate having a first thickness, a second filter plate having a second thickness, and a third filter plate having a third thickness, such that a thickness of the filter is one of zero, the first thickness, the second thickness, a sum of the first thickness and the second thickness, and a sum of the first thickness, the second thickness, and the third thickness, wherein, corresponding to each thickness, the plurality of cams are rotated by 72° such that the driving wheel is rotated anticlockwise and the plurality of cams located respectively at a left side and at a right side of the driving wheel are rotated clockwise, and wherein groove curves for respectively controlling the first filter plate and the third filter plate are respectively provided on a front surface and a back surface of the cam located at the right side.

6. A filter according to claim 3, wherein the plurality of filter plates are made of copper or tin, and the first thickness and the second thickness are respectively approximately 0.1 millimeters (mm) and 0.2 mm.

7. A filter according to claim 4, wherein the first filter plate and the second filter plate are made of copper or tin, the first thickness and the second thickness are respectively approximately 0.1 millimeters (mm) and 0.2 mm, and the third filter plate is made of tin or copper.

8. A filter according to claim 5, wherein the first filter plate and the second filter plate are made of copper or tin, the first thickness and the second thickness are respectively approximately 0.1 millimeters (mm) and 0.2 mm, and the third filter plate is made of tin or copper.

9. An X-ray imaging apparatus comprising:

an X-ray irradiating device configured to emit X-rays; and a filter arranged such that the X-rays pass therethrough, the filter comprising:

a plurality of filter plates configured to adjust an X-ray energy spectrum, wherein the plurality of filter plates comprises three filter plates;

a plurality of rails for fixedly supporting the filter plates, the filter plates being provided in a laminated structure on guiders of the plurality of rails;

a plurality of cams which are respectively provided with a groove curve on a surface thereof, wherein a surface of one of the cams comprises a second groove curve;

a driving wheel configured to drive the plurality of cams; and a plurality of link levers comprising three link levers, each link lever being connected to one of the filter plates at a first end and being mounted to an axis at an opposite second end such that the link lever is rotatable about the axis, each link lever comprising a pin which is in cooperation with the groove curve of the corresponding cam so that the link lever proceeds with a reciprocating movement according to rotation of the corresponding cam to move the filter connected to it into or out of an X-ray passing space, wherein the plurality of cams are respectively located at a left side and a right side of the driving wheel to move the filter plates into the X-ray passing space from different directions, wherein the second groove curve of the one of the cams is in cooperation with the pin on a third link lever.

10. An X-ray imaging apparatus according to claim 9, wherein the groove curve on each cam is based by:

where N is a number of filter thickness states that can be switched, a calculated minimum rotation angle of each cam in each thickness switch by 360°/N;

a corresponding radius of the groove curve is set as minimum value when one of the plurality of filter plates is in an O region retreating from the X-ray passing space;

the corresponding radius of the groove curve is set as a maximum value when the one of the plurality of filter plates is in a W region advancing into the X-ray passing space;

a determination of whether the driving wheel is rotated clockwise or anticlockwise;

a setting of the O region and W region of the filter plates according to a space size and structure of a collimator box; and a determination of whether the plurality of cams are located at a left side or a right side of the filter, wherein the O region represents the non X-ray passing space and the W region represents the X-ray passing space.

11. An X-ray imaging apparatus according to claim 10, wherein the plurality of filter plates comprises a first filter plate having a first thickness and a second filter plate having a second thickness such that the filter has one of a first thickness that indicates that there is no filter in the X-ray passing space, a second thickness that indicates that the filter includes the first filter plate with the first thickness in the X-ray passing space, a third thickness that indicates that the filter includes the second filter plate with the second thickness in the X-ray passing and a fourth thickness that indicates that the filter includes the first filter plate and the second filter plate in the X-ray passing space, and wherein, corresponding to each thickness, the plurality of cams will be rotated by an angle of 90° such that the driving wheel is rotated anticlockwise and the plurality of cams are rotated clockwise.

12. An X-ray imaging apparatus according to claim 10, wherein the plurality of filter plates comprises a first filter plate having a first thickness, a second filter plate having a second thickness, and a third filter plate having a third thickness, such that a thickness of the filter is one of zero, the first thickness, the second thickness, a sum of the first thickness and the second thickness, and the third thickness, wherein, corresponding to each thickness, the plurality of cams are rotated by an angle of 72° such that the driving wheel is rotated anticlockwise and the plurality of cams are located respectively at a left side and at a right side of the driving wheel are rotated clockwise, and wherein groove curves for respectively controlling the first filter plate and the third filter plate are respectively provided on a front surface and a back surface of the cam located at the right side.

13. An X-ray imaging apparatus according to claim 10, wherein the plurality of filter plates comprises a first filter plate having a first thickness, a second filter plate having a second thickness, and a third filter plate having a third thickness, such that a thickness of the filter is one of zero, the first thickness, the second thickness, a sum of the first thickness and the second thickness, and a sum of the first thickness, the second thickness, and the third thickness, wherein, corresponding to each thickness, the plurality of cams are rotated by 72° such that the driving wheel is rotated anticlockwise and the plurality of cams located respectively at a left side and at a right side of the driving wheel are rotated clockwise, and wherein groove curves for respectively controlling the first filter plate and the third filter plate are respectively provided on a front surface and a back surface of the cam located at the right side.

14. An X-ray imaging apparatus according to claim 11, wherein the plurality of filter plates are made of copper or tin, and the first thickness and the second thickness are respectively approximately 0.1 millimeters (mm) and 0.2 mm.

15. An X-ray imaging apparatus according to claim 12, wherein the first filter plate and the second filter plate are made of copper or tin, the first thickness and the second thickness are respectively approximately 0.1 millimeters (mm) and 0.2 mm, and the third filter plate is made of tin or copper.

16. An X-ray imaging apparatus according to claim 13, wherein the first filter plate and the second filter plate are made of copper or tin, the first thickness and the second thickness are respectively approximately 0.1 millimeters (mm) and 0.2 mm, and the third filter plate is made of tin or copper.

* * * * *

UNITED STATES PATENT AND TRADEMARK OFFICE

CERTIFICATE OF CORRECTION

PATENT NO. : 8,184,776 B2
APPLICATION NO. : 12/751364
DATED : May 22, 2012
INVENTOR(S) : Yuan It is certified that error appears in the above-identified patent and that said Letters Patent is hereby corrected as shown below:

In Column 11, Line 18, in Claim 3, delete “passing” and insert -- passing space --, therefor.

In Column 12, Line 65, in Claim 11, delete “passing” and insert -- passing space --, therefor.

Signed and Sealed this
Twentieth Day of November, 2012

David J. Kappos

David J. Kappos
*Director of the United States Patent and Trademark Office*